US005673786A

United States Patent [19]

Seymour et al.

[11] Patent Number: 5,673,786

[45] Date of Patent: Oct. 7, 1997

[54] CIRCUIT BREAKER BELL ALARM RESET MECHANISM

[75] Inventors: Raymond K. Seymour, Plainville; Roger N. Castonguay, Terryville; Michael C. Guerrette, Bristol, all of Conn.

[73] Assignee: General Electric Company, New York, N.Y.

[21] Appl. No.: 627,641

[22] Filed: Apr. 4, 1996

[51] Int. Cl.[6] ..... H01H 9/00

[52] U.S. Cl. ..... 200/308; 200/401

[58] Field of Search ..... 200/400, 401, 200/308; 361/99, 49, 115; 335/17

[56] References Cited

U.S. PATENT DOCUMENTS 3,214,537 10/1965 Krieger ..... 335/17

4,001,742 1/1977 Jencks et al. ..... 335/173

4,672,501 6/1987 Bilac et al. ..... 361/96

5,502,286 3/1996 Pollman et al. ..... 200/401

*Primary Examiner*—David J. Walczak

*Attorney, Agent, or Firm*—Richard A. Menelly; Carl B. Horton

[57] ABSTRACT

A circuit breaker bell alarm reset mechanism interfaces between the circuit breaker operating shaft and the bell alarm plunger to directly contact the plunger in response to rotational logic provided by the operating shaft. Rotation of the operating shaft to reset the circuit breaker operating mechanism simultaneously motivates the reset mechanism to reset the bell alarm plunger.

7 Claims, 4 Drawing Sheets

CIRCUIT BREAKER BELL ALARM RESET MECHANISM

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the circuit breaker operating mechanisms control the powerful operating springs that open and close the circuit breaker contacts. Once the operating mechanism has responded to separate the contacts, the operating springs must be recharged to supply sufficient motive force to the movable contact arms that carry the contacts.

U.S. Pat. No. 5,502,286 entitled "Bell Alarm and Lockout for High Ampere-Rated Circuit Breakers" describes a spring-loaded plunger that contacts the circuit breaker operating mechanism at one end and extends a signal flag at an opposite end to provide local indication as to the status of the circuit breaker contacts. A switch arrangement provides remote indication over a pair of electrical conductors. One problem with such bell alarm indicating devices is the difficulty in resetting the bell alarm plunger once the circuit breaker contacts have been reset.

One purpose of the present invention is to resolve the resetting of the bell alarm plunger in an efficient and economic manner.

SUMMARY OF THE INVENTION

A circuit breaker bell alarm reset mechanism interfaces between the circuit breaker operating shaft and the bell alarm plunger by means of a bell alarm driver link that is pivotally attached to a cam formed on the operating shaft. The bell alarm driver link interacts with one end of a two piece reset lever to rotate the bell alarm driver link in correspondence with the driver shaft rotation.

DESCRIPTION OF THE PREFERRED EMBODIMENT

Figure 1:
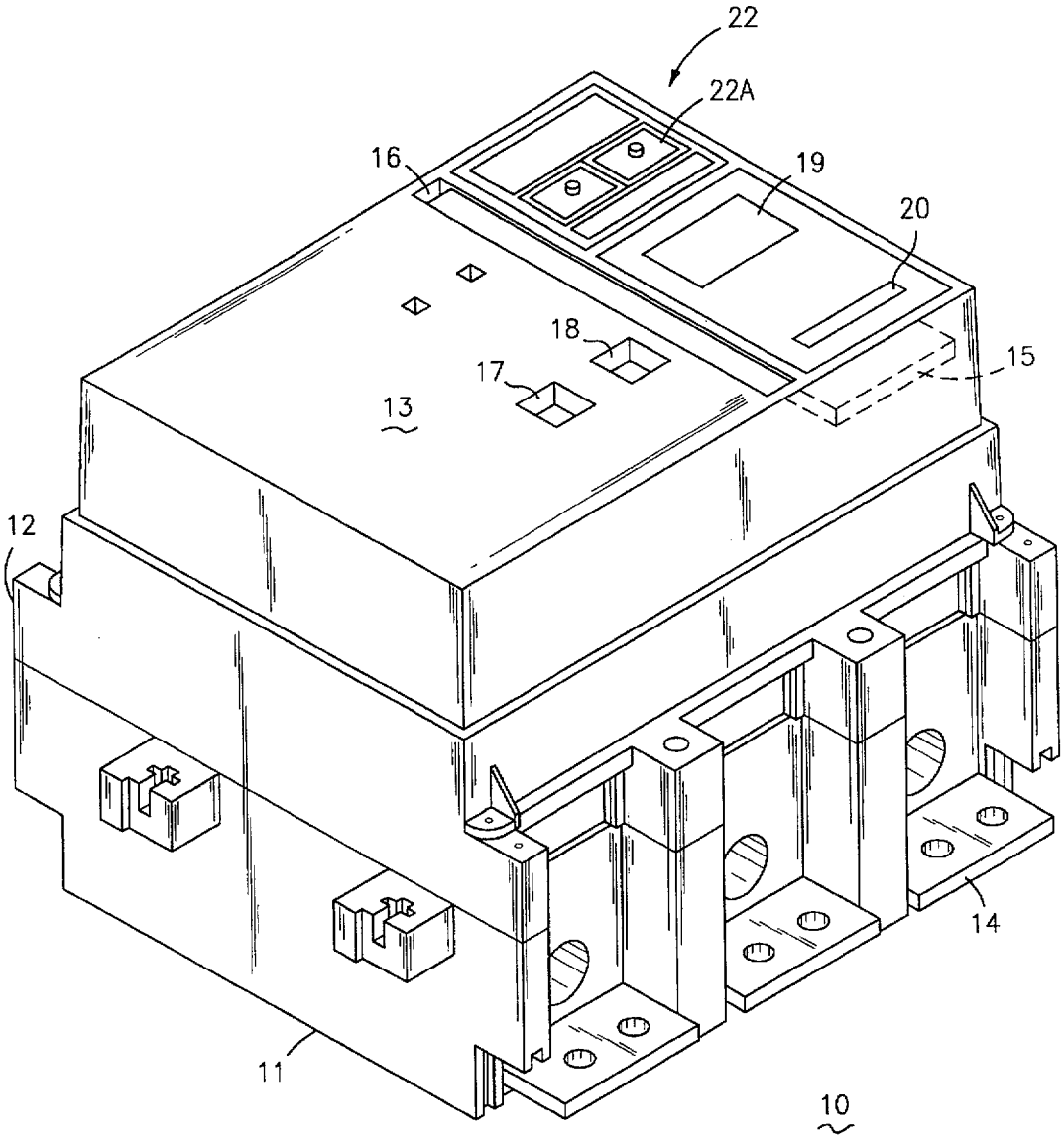
FIG. 1 is a top perspective view of a high ampere-rated circuit breaker that includes a bell alarm unit and bell alarm reset mechanism according to the invention.

The high ampere-rated circuit breaker 10 shown in FIG. 1 is capable of transferring several thousand amperes quiescent circuit current at several hundred volts potential. The circuit breaker consists of an electrically insulated base 11 to which an intermediate cover 12 of similar insulative material is attached prior to attaching the top cover 13 also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit 15 contained within the top cover 13. The trip unit is similar to that described within U.S. Pat. No. 4,672,501 and interacts further with a bell alarm unit accessory 22 within an accessory recess 22A to provide local indication, by means of the signal flag 22B, of the conditions of the circuit breaker contacts 36,37 (FIG. 3) arranged within the circuit breaker case 11 as well as remote indication by means of electrical conductors 27 (FIG. 2) that connect with a remote indicating lamp. The operating handle 16 allows manual operation of the circuit breaker operating mechanism to open and close the circuit breaker contacts. The contacts can also be automatically opened and closed by means of buttons 17,18 accessible on the top cover 13. The trip unit settings can be observed by means of the display 19 and the associate key pad 20.

Figure 2:
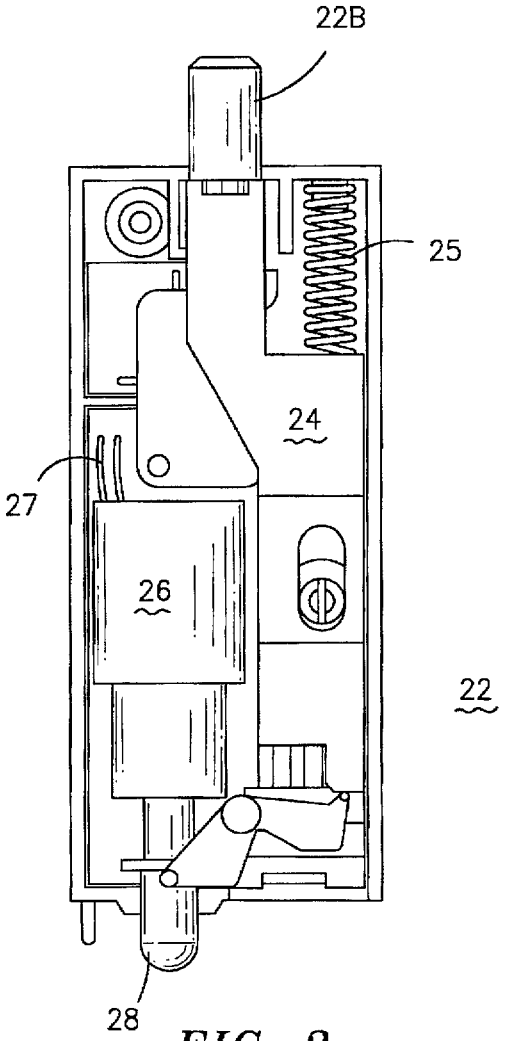
FIG. 2 is an enlarged front plan view of the bell alarm top perspective view of the bell alarm unit of FIG. 1 with the cover removed to depict the internal components.

As described within the aforementioned U.S. Pat. No. 5,502,286, the bell alarm unit 22 is shown in FIG. 2 to consist of a plunger 28 that extends downward within the circuit breaker cover and energizes the microswitch 26 to send a remote indication signal over conductors 27 to an alarm or indicating lamp remote from the circuit breaker enclosure. The plunger connects with a slide assembly 24 to motivate the signal flag 22B against the bias of the return spring 25 to provide local indication, for example, that the circuit breaker contacts have responded to interrupt the associated circuit current.

Figure 3:
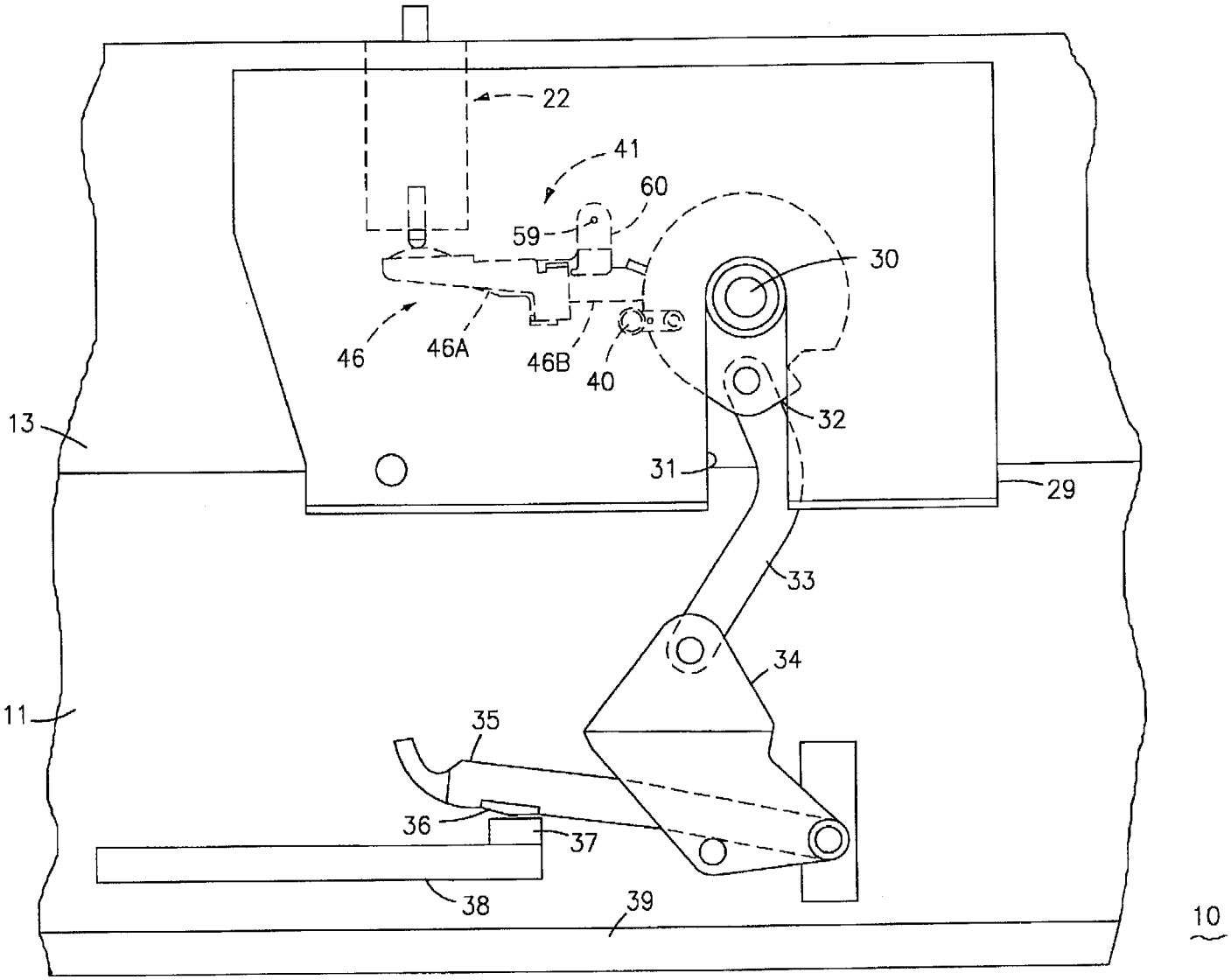
FIG. 3 is an enlarged plan side view of a part of the circuit breaker on FIG. 1 depicting the movable contact arm assembly and the bell alarm reset mechanism.

In accordance with the invention, the circuit breaker 10 depicted in FIG. 3, includes a bell alarm reset driver 41 contained within the circuit breaker cover 13 that interacts with the circuit breaker contact carrier 34 within the circuit breaker case 11 by means of the contact arm driver link 33 and the cam 32 connected with the circuit breaker operating mechanism drive shaft 30. As described within the aforementioned U.S. Pat. No. 4,001,742, the fixed contacts 37 are attached to the bottom 39 of the circuit breaker case 11 by means of the support strap 38 and the movable contact 36 is attached to the movable contact arm 35 which responds to the rotation of the contact carrier 34 and the contact arm driver link 33. The operating mechanism drive shaft 30 extends through a slot 31 in the operating mechanism side frame 29 to which the bell alarm driver 41 is attached by means of the pivot arm 60. The pivot arm 60 is fixedly attached to the reset lever arm 46B at one end and is attached to the operating mechanism side frame 29 at the opposite end by means of the pivot pin 59. Operative connection between the bell alarm unit 22 and the cam 32 is made by means of the bell alarm driver link 40 and the two piece bell alarm reset lever 46 consisting of the arms 46A, 46B, as indicated.

Figure 4A:
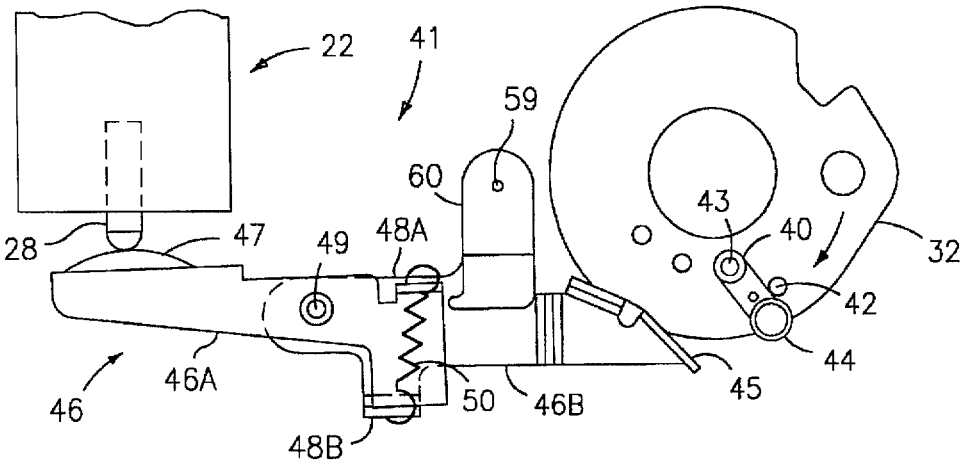
FIGS. 4A–4D are enlarged side plan views of the arrangement of the bell alarm reset mechanism of FIG. 3 intermediate the circuit breaker operating shaft and the bell alarm unit.
Figure 4B:
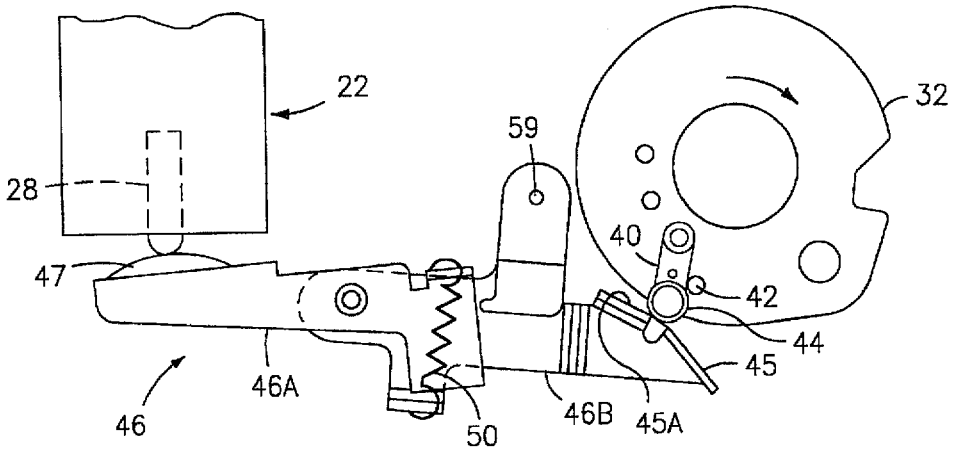
Figure 4C:
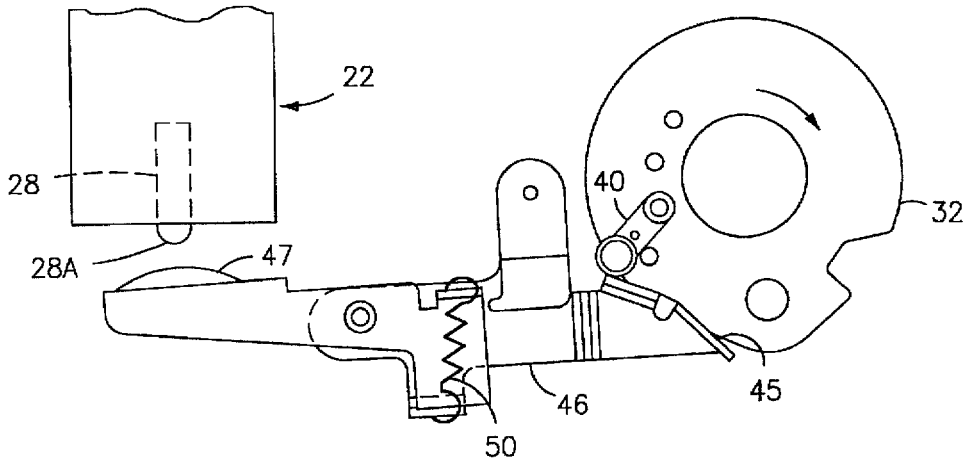
Figure 4D:
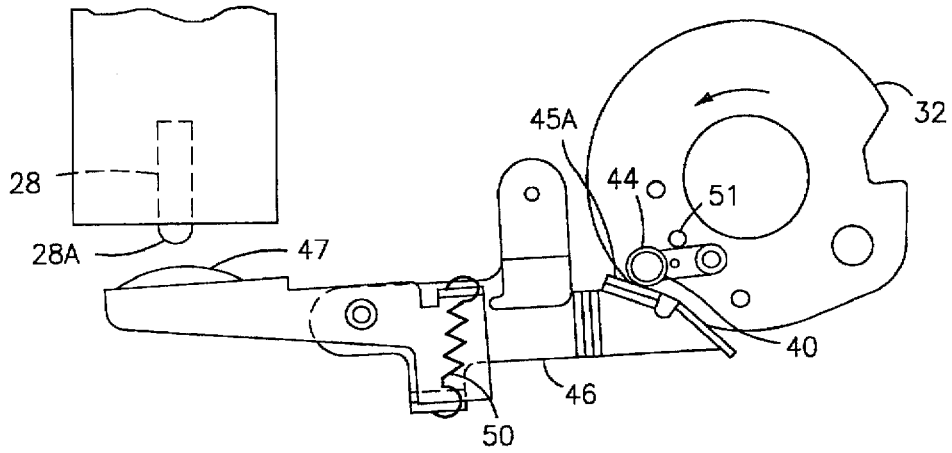

The interaction between the reset lever 46, the bell alarm plunger 28 on the bell alarm unit 22, and the bell alarm driver link 40 on the cam 32 is best seen by now referring to FIGS. 4A–4D. With the circuit breaker contacts 36, 37 of FIG. 3 in the OFF condition, the plunger 28, in FIG. 4A, is extended downward into contact With the flat spring 47 on one arm 46A of the reset lever 46 and the roller 44 on the bell alarm driver link 40 is away from the tab 45 on the opposite end of the reset lever and is positioned against the driver pin 42 on the cam 32. The bell alarm driver link 40 is attached to the cam 32 by means of the pivot 43 for free rotation about the pivot in response to rotation of the cam 32 as the cam rotates to open and close the circuit breaker contacts. The reset lever arm 46A is attached to the reset lever arm 46B by means of the pivot 49 which allows the rotation of the reset lever under the holding bias of the compensation spring 50, which is attached at opposite ends to the reset lever arms 46A, 46B as indicated at 48A and 48B. When the cam 32 is rotated in the clockwise indicated direction, the drive pin 42 rotates the roller 44 against the tab 45 on the end of the reset lever 46 rotating the reset lever clockwise and striking the flat spring 47 on the opposite end of the reset lever against the plunger driving the plunger upwards within the bell alarm unit 22 where it is retained by means of permanent magnet (not shown). The compensation spring 50 becomes extended as the cam 32 continues to rotate clockwise from the RESET position in FIG. 4A to the ON position depicted in FIG. 4B where the cam 32 further rotates the roller 44 onto the top 45A of the tab 45 driving the reset lever arm 46A away from the end 28A of the plunger 28 and then contracting the compensation spring 50, as indicated in FIG. 4C. The rotation of the cam 32 in the indicated counter-clockwise direction shown in FIG. 4D, drives the stop pin 51 on the cam 32 against the bell alarm driver link 40 and traps the roller 44 against the top 45A to hold the flat spring 47 on the end of the reset lever away from the end 28A of the plunger 28. Rotation of the cam 32 in the clockwise direction returns the flat spring 47 into abutment with the end 28A of the plunger 28 as shown earlier in FIG. 4A.

A simple arrangement has herein been described for resetting the bell alarm accessory unit in direct response to the rotation of the circuit breaker operating mechanism drive shaft. The direct response eliminates any possibility of incorrect indication of the ON and OFF conditions of the circuit breaker contacts.

We claim:

1. A circuit breaker for high ampere-rated circuit interruption comprising:

an insulative case;

an insulative cover above said case, said cover enclosing a drive shaft extending from an operating mechanism sideframe controlling ON and OFF conditions of a pair of circuit breaker contacts;

a bell alarm unit including a bottom plunger extending within said case and a top indicating flag arranged for extending above said case;

a bell alarm driver assembly interfacing between said bell alarm unit and said drive shaft for contacting said bottom plunger and extending said indicating flag above said case for indication of said OFF states of said circuit breaker contacts; and a bell alarm driver link pivotally-attached to a cam on said drive shaft at one end and terminating at a roller at an opposite end, said roller being arranged for contacting a reset lever pivotally-attached within said driver assembly, said reset lever consisting of a pair of first and second arms.

2. The circuit breaker of claim 1 including a drive pin on said cam, said drive pin arranged for driving said bell alarm driver link into contact with a tab on a first arm of said reset lever.

3. The circuit breaker of claim 2 wherein said reset lever includes a flat spring on said second arm thereof, said flat spring arranged for contacting an end of said plunger.

4. The circuit breaker of claim 2 wherein said tab defines a top part whereby said roller exerts a force against said first arm thereby causing said second arm to rotate away from said end of said plunger.

5. The circuit breaker of claim 1 including a compensation spring connecting between said first and second arms.

6. The circuit breaker of claim 5 including a stop pin on said cam, said stop pin being contacted by said driver link when said cam is rotated in a counter-clockwise direction.

7. The circuit breaker of claim 1 wherein one of said contacts is attached to a contact carrier.

* * * * *